US007571772B2

(12) United States Patent
Reams

(10) Patent No.: US 7,571,772 B2
(45) Date of Patent: Aug. 11, 2009

(54) SYSTEM, METHOD, AND APPARATUS FOR A RADIALLY-MOVABLE LINE TERMINATION SYSTEM FOR A RISER STRING ON A DRILLING RIG

(75) Inventor: James R. Reams, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 532 days.

(21) Appl. No.: 11/230,081

(22) Filed: Sep. 19, 2005

(65) Prior Publication Data

US 2007/0063507 A1 Mar. 22, 2007

(51) Int. Cl.
*E21B 29/12* (2006.01)

(52) U.S. Cl. ..... 166/367; 166/344; 166/345; 166/347

(58) Field of Classification Search ..... 166/347, 166/344, 367
See application file for complete search history.

(56) References Cited

U.S. PATENT DOCUMENTS 3,220,477 A * 11/1965 Jones ..... 166/351
3,523,578 A * 8/1970 Crain et al. ..... 166/359
3,955,621 A 5/1976 Webb
3,973,635 A * 8/1976 Gatlin et al. ..... 175/7
4,142,584 A * 3/1979 Brewer et al. ..... 166/359
4,364,433 A * 12/1982 Fisher et al. ..... 166/339
4,403,658 A * 9/1983 Watkins ..... 166/355
4,592,426 A * 6/1986 Neely ..... 166/347
4,712,620 A * 12/1987 Lim et al. ..... 166/355
4,746,247 A * 5/1988 Arlt et al. ..... 405/224
5,727,630 A * 3/1998 Brammer ..... 166/355
5,873,678 A * 2/1999 Moses ..... 405/223.1
6,530,430 B2 3/2003 Reynolds
6,554,072 B1 * 4/2003 Mournian et al. ..... 166/355
6,585,455 B1 * 7/2003 Petersen et al. ..... 405/224.4
6,708,766 B2 * 3/2004 Clark ..... 166/368
6,793,019 B2 * 9/2004 Rodgers et al. ..... 166/344
7,059,416 B2 * 6/2006 Dailey et al. ..... 166/359
7,318,479 B2 * 1/2008 Williams ..... 166/341

FOREIGN PATENT DOCUMENTS

GB 2259127 A 3/1993

* cited by examiner

*Primary Examiner*—Thomas A Beach
(74) *Attorney, Agent, or Firm*—Bracewell & Giuliani

(57) ABSTRACT

A line termination assembly for a riser string has a ring adapter mounted to a slip joint and a ring body mounted on top of the ring adapter. The ring adapter radially aligns with the ring body, which forms an inner diameter for receiving the slip joint. The ring body also has a discontinuity for radial access to the inner diameter, such that the ring body is circumferentially discontinuous. The discontinuity defines a chord dimension that exceeds the outer diameter of the slip joint, such that the slip joint may move radially through the discontinuity and into the inner diameter during assembly and disassembly of the system. Fluid bearings and tension rings are mounted to the slip joint and are axially spaced apart from the ring adapter and the ring body.

16 Claims, 5 Drawing Sheets

SYSTEM, METHOD, AND APPARATUS FOR A RADIALLY-MOVABLE LINE TERMINATION SYSTEM FOR A RISER STRING ON A DRILLING RIG

BACKGROUND OF THE INVENTION

1. Technical Field

The present invention relates in general to terminating choke, kill, and auxiliary lines for riser strings on an offshore drilling rig and, in particular, to an improved system, method, and apparatus for a line termination system that is radially-movable relative to the riser string.

2. Description of the Related Art

Offshore drilling rigs must compensate for many environmental hazards including tidal conditions, ocean swells, and weather conditions such as wind and severe weather. The forces generated by these hazards cause significant motion of the rig that must be compensated to maintain the continuity of the riser string that extends down from the rig and is fixed to the ocean floor. A slip joint is typically used near an upper end of the riser string to compensate for vertical motion of the rig. The slip joint compensates for motion with inner and outer barrels that move axially relative to each other. The various choke, kill, and auxiliary lines associated with riser strings also must be configured to compensate for motion. These lines are typically terminated adjacent the slip joint with a device such as a Karrot Top or KT ring assembly.

A conventional KT ring assembly 11 is shown in FIG. 1 and comprises a ring adapter 13 that is mounted to the outer barrel 15 of the slip joint 17. The ring adapter 13 lands on a shoulder 19 inside a large, solid ring body 21, which completely circumscribes the ring adapter 13 and slip joint 17. The ring body 21 includes numerous terminal blocks 23 for terminating the choke, kill, and auxiliary lines. The ring body 21 also typically incorporates a fluid bearing 25 and a tension ring 27 for supporting the overall assembly.

Although conventional KT rings provide numerous advantages they also have a few limitations. For example, because the ring body is solid, the entire riser string must be run through the KT ring assembly during construction of the riser string. The large size of the ring body makes it somewhat cumbersome to manipulate, and it consumes significant space between the floors of drilling rig. In addition, the ring body must first be secured to the bottom of the diverter housing. Thus, although conventional KT rings are workable, an improved design would be desirable.

SUMMARY OF THE INVENTION

One embodiment of a system, method, and apparatus for a line termination assembly comprises a ring adapter that is mounted to a slip joint and a ring body mounted to the ring adapter. The ring adapter has an upper surface with a recess formed therein, and the ring body has a lower surface with a protuberance extending therefrom seated in the recess on the ring adapter for radial alignment therebetween. The ring body forms an inner diameter that is located radially inward from the protuberance. Lock pins secure the ring adapter to the ring body, and a key pin on the ring body rotationally aligns the ring body with the ring adapter via a key receptacle on the ring adapter.

The ring body also has a discontinuity such that the ring body is circumferentially discontinuous with respect to the slip joint. The discontinuity defines a chord dimension that exceeds the outer diameter of the slip joint, such that the slip joint may move in a radial direction, relatively speaking, through the discontinuity and into the inner diameter during assembly and disassembly of the riser string. Terminal blocks are mounted to the ring body for terminating the choke, kill, and auxiliary lines. The ring body may be removed from the slip joint in the radial direction, positioned on a mandrel, and independently tested with the termination lines separately from the ring adapter. The fluid bearings and tension rings of the system are directly mounted to the slip joint and are axially spaced apart from the ring adapter and the ring body.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
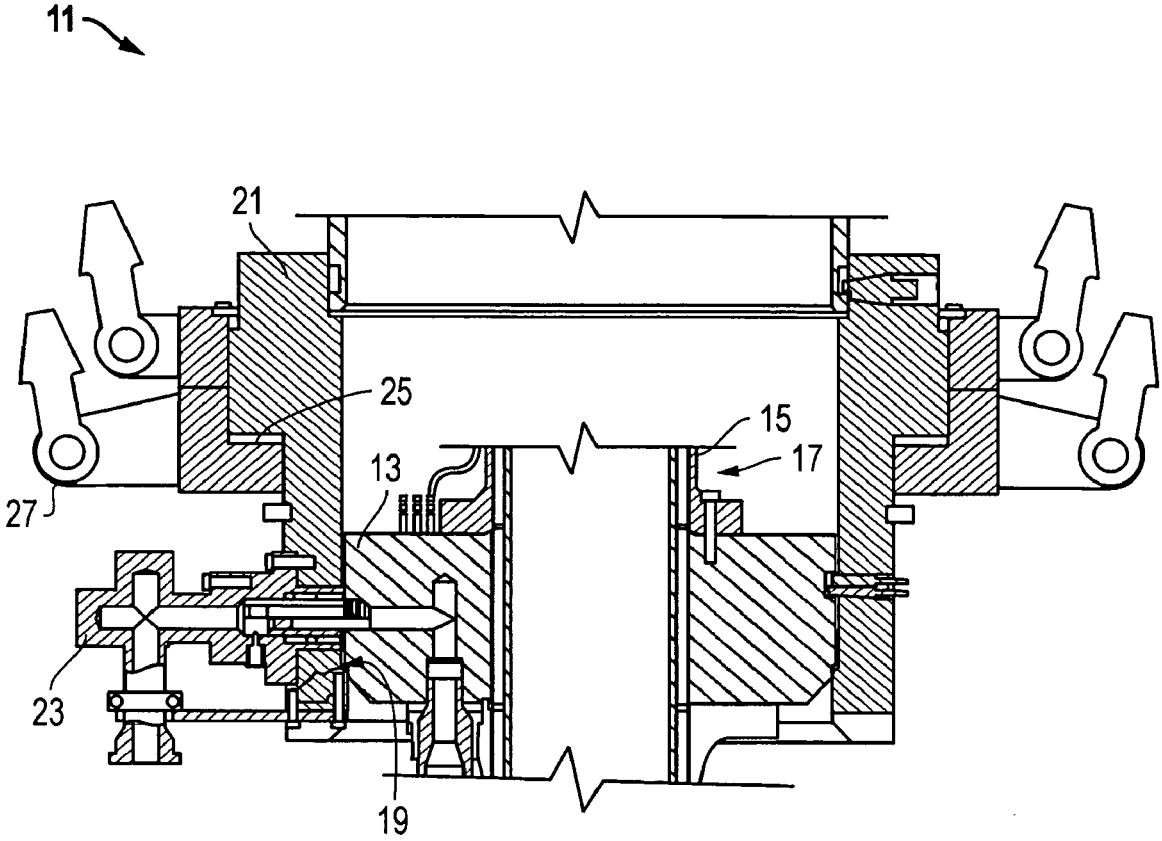
FIG. 1 (Prior Art)
FIG. 1 is a sectional side view of a conventional KT ring assembly.
Figure 2:
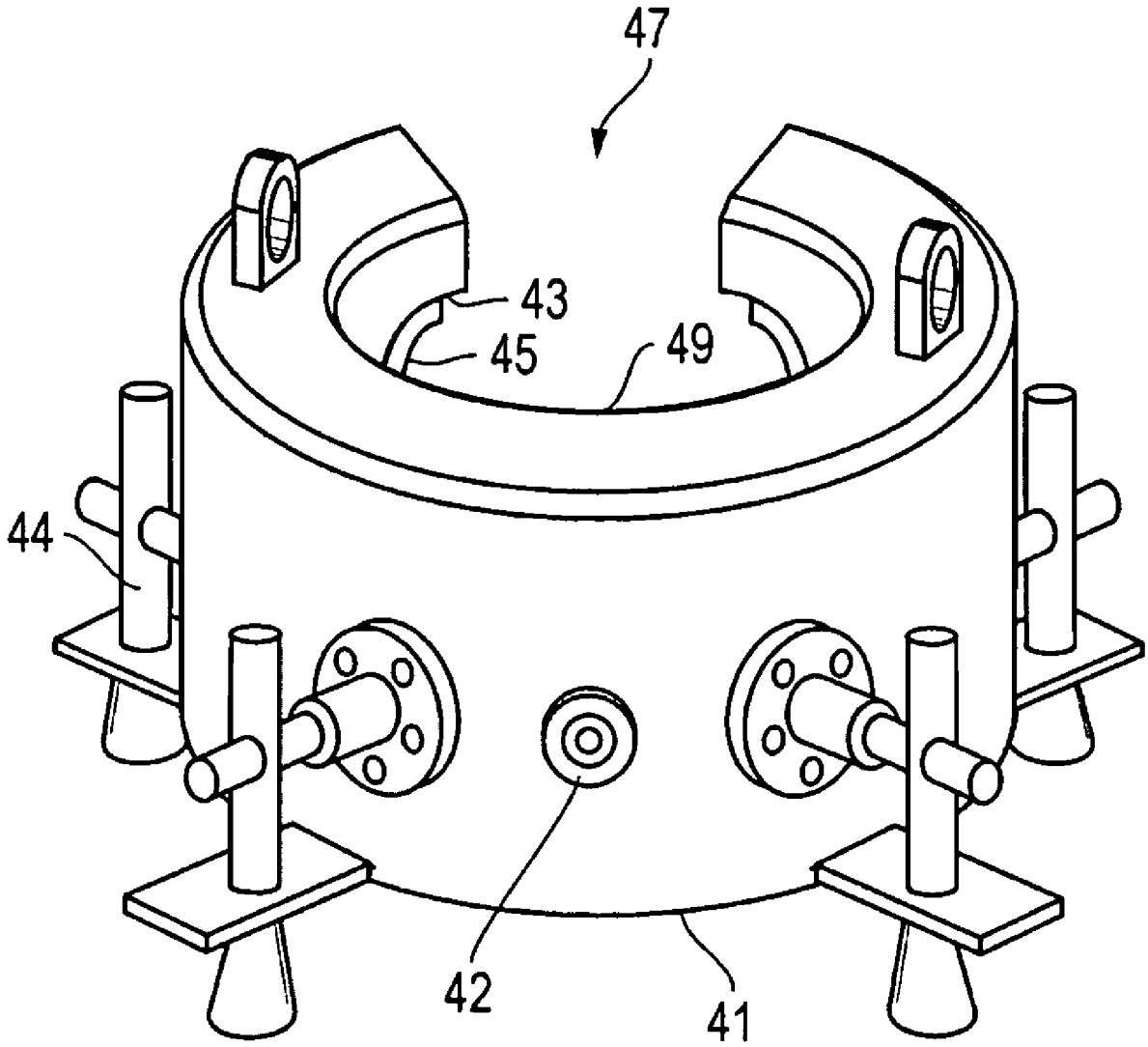
FIG. 2 is an isometric view of one embodiment of a line termination assembly constructed in accordance with the present invention.

Referring to FIGS. 2-5, one embodiment of a system, method, and apparatus constructed in accordance with the present invention is shown. The present invention comprises a line termination system 21 (FIGS. 3 and 4) for a riser string and is well suited for use with a slip joint 23 having an axis 25 and an outer barrel 27 with an outer diameter 29. A ring adapter 31 is mounted to the outer barrel 27 of the slip joint 23. The ring adapter 31 has an upper surface 33 with a recess 35 formed therein and, in one embodiment, the ring adapter 31 is circumferentially continuous with respect to the slip joint 23.

Figure 3:
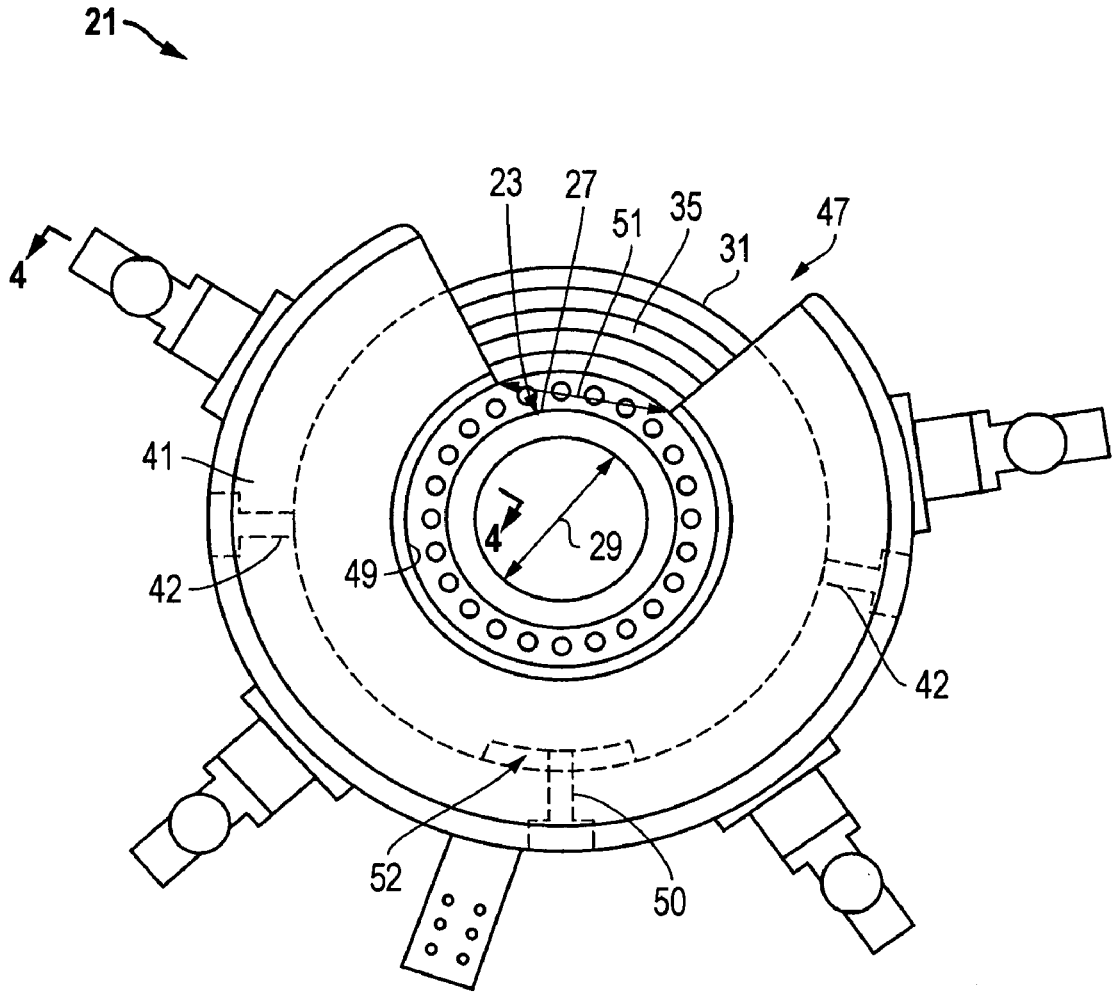
FIG. 3 is a top view of the line termination assembly of FIG. 2 shown installed on a slip joint and is constructed in accordance with the present invention.
Figure 4:
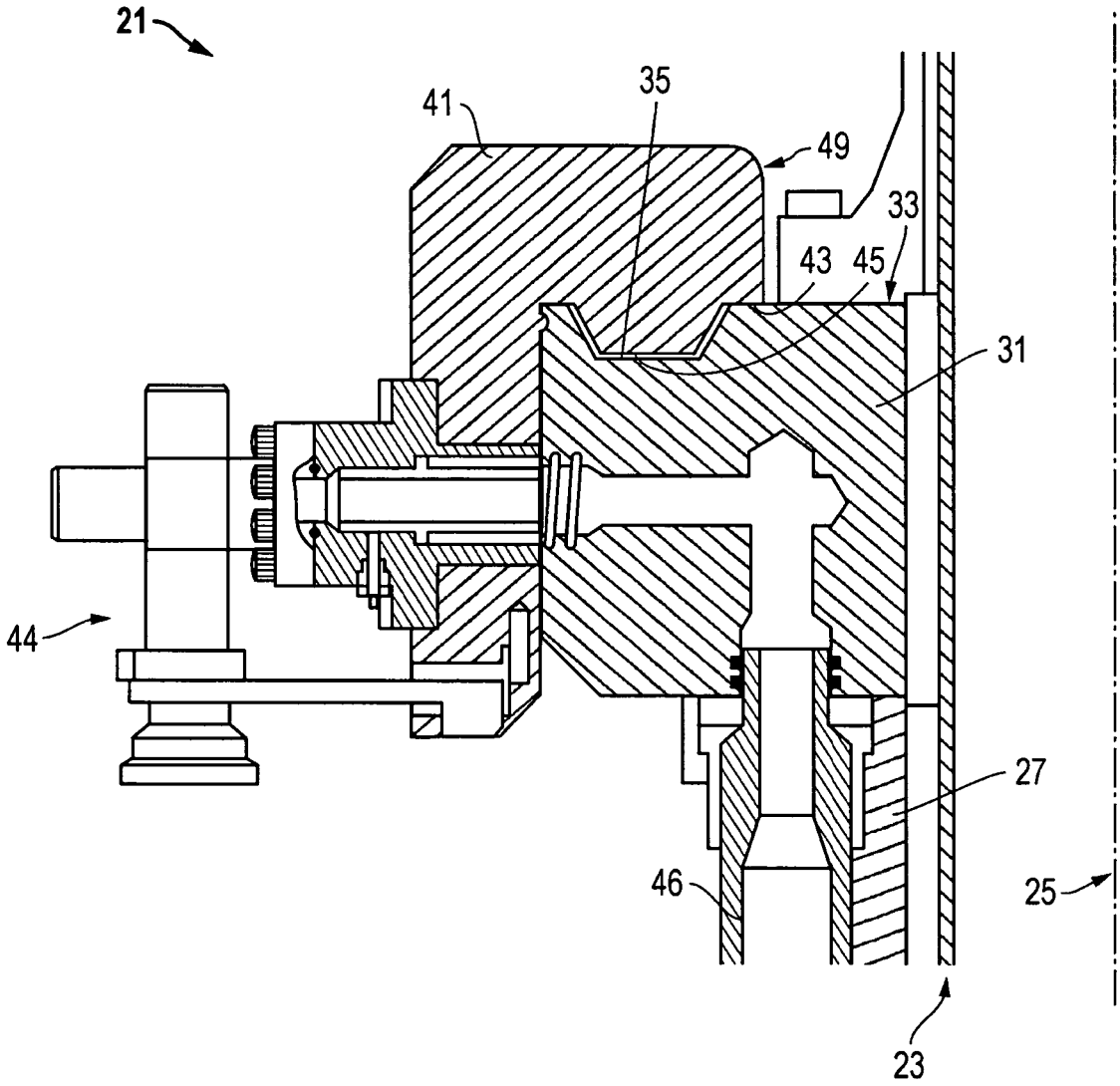
FIG. 4 is an enlarged, half-sectional side view of the line termination assembly and slip joint of FIG. 3, taken along the line 4-4 of FIG. 3, and is constructed in accordance with the present invention.

The line termination system 21 also includes a ring body 41 (FIGS. 2-4) that is mounted to the ring adapter 31. The ring body 41 has a lower surface 43 (FIG. 4) with a protuberance 45 extending therefrom. The protuberance 45 seats in the recess 33 on the ring adapter 31 to provide radial alignment between the ring adapter 31 and ring body 41. In one embodiment, the protuberance 45 on the ring body 41 is a semi-circular rim, and the recess 33 on the ring adapter 31 is a circular trough. As shown in FIG. 3, lock pins 42 are used to secure the ring adapter 31 to the ring body 41. A key pin 50 on the ring body 41 is used to rotationally align the ring body 41 with a key receptacle 52 on the ring adapter 31.

A discontinuity 47 is formed in the ring body 41 such that the ring body 41 is circumferentially discontinuous with respect to the slip joint 23. The ring body 41 has an inner diameter 49 that is located radially inward from the protuberance 45. The discontinuity 47 defines a chord dimension 51 that exceeds the outer diameter 29 of the outer barrel 27 of the slip joint 23. This configuration allows the ring body 41 to move radially relative to the slip joint 23. The slip joint 23 passes through the discontinuity 47 in a radial direction and into the inner diameter 49 during assembly and disassembly of the riser string. In addition, the ring body 41 may be removed from the slip joint 23 in the radial direction, positioned on a mandrel, and independently tested with the choke, kill, and auxiliary lines separately from the ring adapter 31.

The ring body 41 also includes a number of terminal blocks 44 mounted to the ring body 41 for terminating choke, kill, and auxiliary lines 46. Significantly, any fluid bearings and tension rings required by the riser string are mounted directly to the slip joint 23 and are axially spaced apart from the ring adapter 31 and the ring body 41. The tension ring has riser tensioner lines secured thereto.

Figure 5:
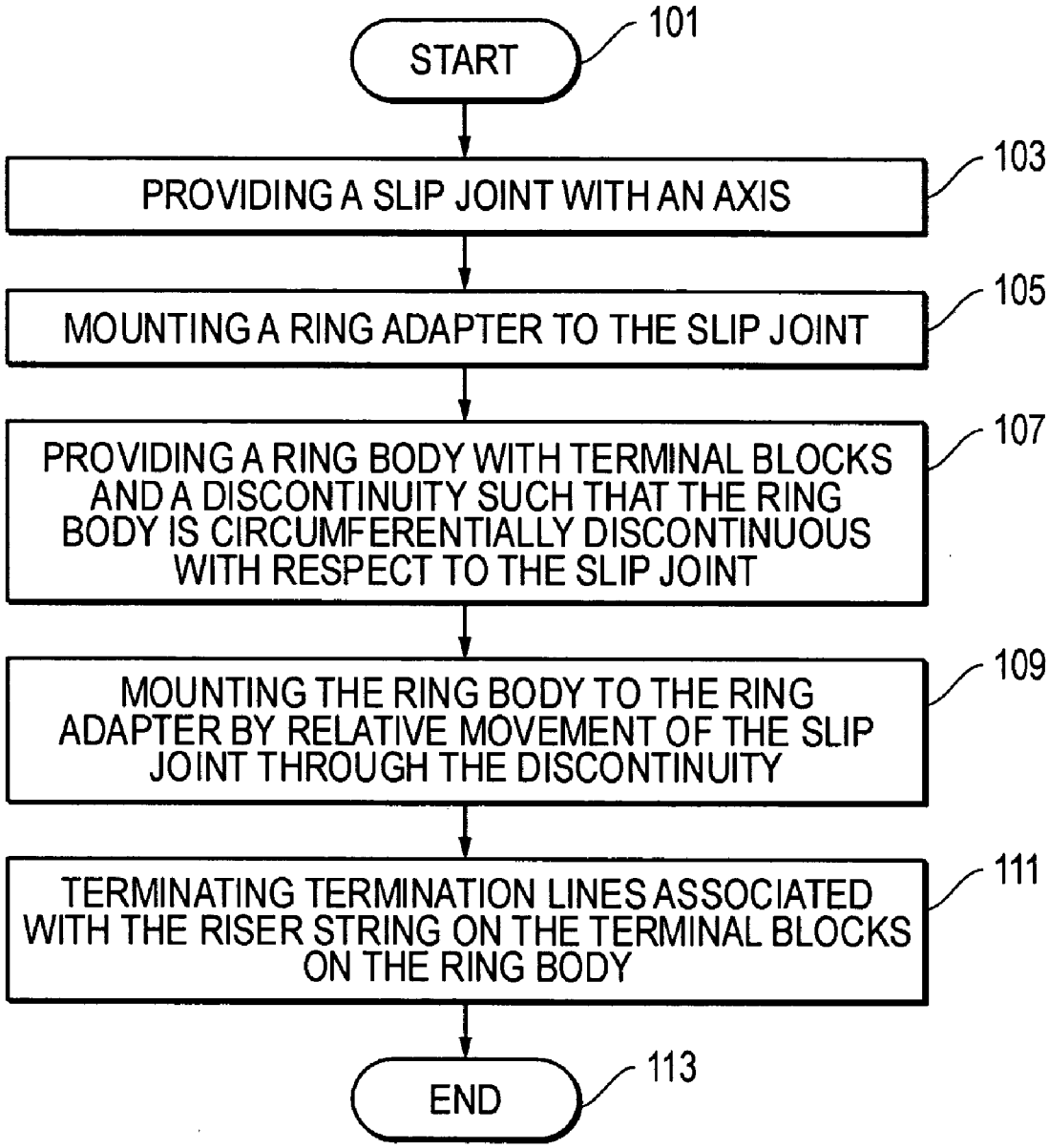
FIG. 5 is a high level flow diagram of one embodiment of a method constructed in accordance with the present invention.

The present invention also comprises a method of forming line terminations for a riser string. As shown in FIG. 5, one embodiment of the method begins as indicated in step 101, and comprises providing a slip joint with an axis (step 103); mounting a ring adapter to the slip joint (step 105); providing a ring body with terminal blocks and a discontinuity such that the ring body is circumferentially discontinuous with respect to the slip joint (step 107); mounting the ring body to the ring adapter by relative movement of the slip joint through the discontinuity (step 109); terminating termination lines associated with the riser string on the terminal blocks on the ring body (step 111); before ending as indicated at step 113.

The method may further comprise defining a chord dimension with the discontinuity that exceeds an outer diameter of the slip joint, and radially moving the ring body such that the slip joint passes through the discontinuity during assembly and disassembly of the riser string. The method also may comprise landing the ring body on top of the ring adapter and radially aligning the ring body with the ring adapter.

In addition, the method may further comprise removing the ring body from the slip joint in a radial direction, positioning the ring body on a mandrel, and independently testing the ring body and termination lines separately from the ring adapter; and/or mounting a fluid bearing and a tension ring to the slip joint axially spaced apart from the ring adapter and the ring body, and securing tensioner lines to the tension ring; and/or securing the ring adapter to the ring body with a plurality of lock pins, and rotationally aligning the ring body to the ring adapter with a key pin and a key receptacle.

The present invention has several advantages, including the ability to be laterally or radially removed from the slip joint so that the entire riser string does not have to be run through the KT ring assembly for any construction on the riser string. The ring body is much smaller than conventional designs, is much easier to manipulate, and consumes significantly less space than its predecessors. In addition, the termination lines can remain secured to the ring body even after it is removed from the slip joint. This feature allows the ring body to be tested independently from the remaining components of the assembly. Moreover, no termination joint is required beneath the slip joint.

While the invention has been shown or described in only some of its forms, it should be apparent to those skilled in the art that it is not so limited, but is susceptible to various changes without departing from the scope of the invention.

What is claimed is:

1. A line termination system for a riser string, comprising:

a slip joint having an axis and an outer diameter;

a ring adapter mounted to the slip joint and having an adapter feature formed therein;

a ring body mounted to the ring adapter and having a body feature for engaging the adapter feature on the ring adapter for radial alignment therebetween, and a discontinuity formed in the ring body such that the ring body is circumferentially discontinuous with respect to the slip joint, wherein the discontinuity defines a dimension that exceeds the outer diameter of the slip joint, such that the ring body moves radially with respect to the slip joint such that the slip joint passes through the discontinuity during assembly and disassembly of the riser string; and a plurality of terminal blocks mounted to the ring body for terminating termination lines associated with the riser, wherein the plurality of terminal blocks are in fluid communication with the termination lines associated with the riser string via the ring adapter string.

2. A line termination system according to claim 1, wherein the ring adapter is circumferentially continuous with respect to the slip joint and the ring body, the body feature on the ring body is a semi-circular rim, and the adapter feature on the ring adapter is a circular trough.

3. A line termination system according to claim 1, wherein the ring body is removed from the slip joint in the radial direction, positioned on a mandrel, and independently tested with the termination lines separately from the ring adapter.

4. A line termination system according to claim 1, further comprising a fluid bearing and a tension ring, each directly mounted to the slip joint and axially spaced apart from the ring adapter and the ring body, the tension ring having riser tensioner lines secured thereto.

5. A line termination system according to claim 1, further comprising a plurality of lock pins for securing the ring adapter to the ring body, and a key pin on the ring body for rotationally aligning the ring body with a key receptacle on the ring adapter.

6. A line termination system for a riser string, comprising:

a ring adapter securable to a slip joint of a riser string and in fluid communication with at least one fluid line of the riser string;

a ring body adapted to extend circumferentially around a portion of the ring adapter and be securable to the ring adapter, the ring body having a discontinuity formed in the ring body such that the ring body is circumferentially discontinuous with respect to the ring adapter;

the discontinuity defining a chord dimension that exceeds the outer diameter of a portion of the riser string, such that the portion of the riser string passes though the discontinuity as the ring body is secured to the ring adapter and released from the ring adapter during assembly and disassembly of the riser string; and a plurality of terminal blocks mounted to the ring body and in fluid communication with the ring adapter for terminating the at least one fluid line of the riser string.

7. A line termination system according to claim 6, wherein the ring adapter comprises a recess on an upper surface and the ring body comprises a protuberance on a lower surface, the protuberance on the ring body being a semi-circular rim and the recess on the ring adapter being a circular trough.

8. A line termination system according to claim 6, wherein the ring body is disposed in a radial direction relative to the portion of the riser string.

9. A line termination system according to claim 6, further comprising the slip joint, a fluid bearing, and a tension ring, the fluid bearing and tension ring being directly mounted to the slip joint and axially spaced apart from the ring adapter and the ring body, the tension ring having riser tensioner lines secured thereto.

10. A line termination system according to claim 6, further comprising a plurality of lock pins for securing the ring adapter to the ring body, and a key pin on the ring body for rotationally aligning the ring body with a key receptacle on the ring adapter.

11. A line termination system according to claim 6, wherein the portion of the riser string is the ring adapter.

12. A method of forming line terminations for a riser string, comprising:

(a) providing a slip joint with an axis;

(b) mounting a ring adapter to the slip joint;

(c) providing a ring body with terminal blocks and a discontinuity such that the ring body is circumferentially discontinuous with respect to the slip joint, wherein providing a ring body with a discontinuity comprises defining the discontinuity with a chord dimension that exceeds an outer diameter of the slip joint;

(d) mounting the ring body to the ring adapter by relative movement of the slip joint through the discontinuity, wherein mounting the ring body to the ring adapter comprises radially moving the ring body such that the slip joint passes through the discontinuity during assembly and disassembly of the riser wherein the plurality of terminal blocks are in fluid communication with the termination lines associated with the riser string via the ring adapter string; and (e) terminating termination lines associated with the riser string on the terminal blocks on the ring body.

13. A method according to claim 12, wherein step (d) comprises landing the ring body on top of the ring adapter and radially aligning the ring body with the ring adapter.

14. A method according to claim 12, further comprising removing the ring body from the slip joint in a radial direction, positioning the ring body on a mandrel, and independently testing the ring body and termination lines separately from the ring adapter.

15. A method according to claim 12, further comprising mounting a fluid bearing and a tension ring directly to the slip joint axially spaced apart from the ring adapter and the ring body, and securing tensioner lines to the tension ring.

16. A method according to claim 12, further comprising securing the ring adapter to the ring body with a plurality of lock pins, and rotationally aligning the ring body to the ring adapter with a key pin and a key receptacle.

* * * * *

UNITED STATES PATENT AND TRADEMARK OFFICE

CERTIFICATE OF CORRECTION

PATENT NO. : 7,571,772 B2
APPLICATION NO. : 11/230081
DATED : August 11, 2009
INVENTOR(S) : James R. Reams It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 841 days.

Signed and Sealed this

Seventh Day of September, 2010

David J. Kappos

David J. Kappos
*Director of the United States Patent and Trademark Office*